US005760750A

United States Patent [19]

Guertin

[11] Patent Number: 5,760,750

[45] Date of Patent: Jun. 2, 1998

[54] BROAD BAND ANTENNA HAVING AN ELONGATED HOLLOW CONDUCTOR AND A CENTRAL GROUNDED CONDUCTOR

[75] Inventor: Wilbur Guertin, Long Branch, N.J.

[73] Assignee: The United States of America as represented by the Secretary of the Army, Washington, D.C.

[21] Appl. No.: 696,432

[22] Filed: Aug. 14, 1996

[51] Int. Cl.[6] ..... H01Q 9/28

[52] U.S. Cl. ..... 343/807; 343/745; 343/808; 343/815

[58] Field of Search ..... 343/773, 786, 343/789, 790, 791, 893, 815, 818, 807, 808, 898, 896

[56] References Cited

U.S. PATENT DOCUMENTS

| | | | |
|---|---|---|---|
| 2,175,256 | 10/1939 | Carter | 343/807 |
| 2,181,870 | 12/1939 | Carter | 343/870 |
| 2,440,597 | 4/1948 | Atwood | 343/807 |
| 2,659,002 | 11/1953 | Keeler | 343/790 |
| 3,618,107 | 11/1971 | Spanos | 343/773 |
| 4,225,869 | 9/1980 | Lohrmann | 343/773 |
| 4,700,196 | 10/1987 | Campbell et al. | 343/808 |
| 4,743,916 | 5/1988 | Bengeult | 343/790 |
| 4,851,859 | 7/1989 | Rappaport | 343/790 |
| 5,367,312 | 11/1994 | Masters | 343/807 |

*Primary Examiner*—Donald T. Hajec
*Assistant Examiner*—Tan Ho
*Attorney, Agent, or Firm*—Michael Zelenka; John M. O'Meara

[57] ABSTRACT

An antenna element comprised of an hollow conductor and a central grounded conductor within the hollow conductor, there being a variation in capacitance between the hollow conductor and the central conductor along their length.

10 Claims, 3 Drawing Sheets

BROAD BAND ANTENNA HAVING AN ELONGATED HOLLOW CONDUCTOR AND A CENTRAL GROUNDED CONDUCTOR

GOVERNMENT INTEREST

The invention described herein may be manufactured, used, sold and/or licensed by or for the Government of the United States of America without payment to us of any royalty thereon.

FIELD OF THE INVENTION

The invention relates in general to antennas.

BACKGROUND OF THE INVENTION

It is well known that for a power generator to be able to deliver the maximum power that it is capable of to a load, the load impedance must be conjugately equal to that of the generator, i.e., the real parts of each (resistance) must be equal, and the reactive or imaginary parts of each (inductive and capacitive reactances) must have the same value but opposite signs for cancellation. In the case of a radio transmitter, its internal impedance may be considered a constant resistance, usually of 50 ohms. However, its load, the antenna, has both real and imaginary components that vary as a function of the radio frequency. Therefore, there only is one frequency at which there is a match of the source and load impedances, and at which there is an efficient transfer of power into the antenna. At all other frequencies, a mismatch occurs between source and load resulting in high losses and less power transferred into the antenna for radiation.

One usual remedial step is the inclusion of an external resistance in the antenna to match the transmitter, but the bulk of the power may be dissipated as heat in the resistor and is not radiated by the antenna even though the transmitter is supplying the maximum power that it's capable of.

Alternately, an impedance-matching filter, also known as an antenna-coupler, may be used to match the transmitter to the antenna. However, it must use components capable of being tuned for each frequency of operation. This takes up a lot of space due to the large components necessary, is very expensive, and requires extensive training of the operator unless complex automatic control circuitry is used. It would be highly advantageous from the standpoint of size, cost, efficiency and speed of operation to have an antenna that has constant real resistance and no reactance at all frequencies so as to eliminate the need for resistance loading or antenna-couplers.

SUMMARY OF THE INVENTION

In accordance with this invention, elements of an antenna are comprised of an elongated hollow conductor and a central grounded conductor mounted within it with the spacing between the conductors being such as to increase the capacitance between them from one end to the other. Thus, for example, the hollow conductor could be a truncated cone and the central conductor a rod mounted on its axis.

The hollow conductor and the central conductor each have inductance distributed along their length, and the capacitance between them gradually varies from one end of the element so as to form an infinite series of low pass filters. Thus, if a source of a given radio frequency is coupled between the conductors at one end of the element, r.f. energy flows along the element until it reaches a point where the filter formed between the conductors cuts off at that given frequency. By suitable design, the distance between the end of the element where energy is applied and the cutoff point can be made to be that required for efficient radiation. Thus, if the frequency of the source is varied, the effective length of the element varies so as to provide efficient operation. The lowest frequencies for which the element is designed will energize its entire length, and the highest frequency will energize a very short length.

DETAILED DESCRIPTION

Figure 1:
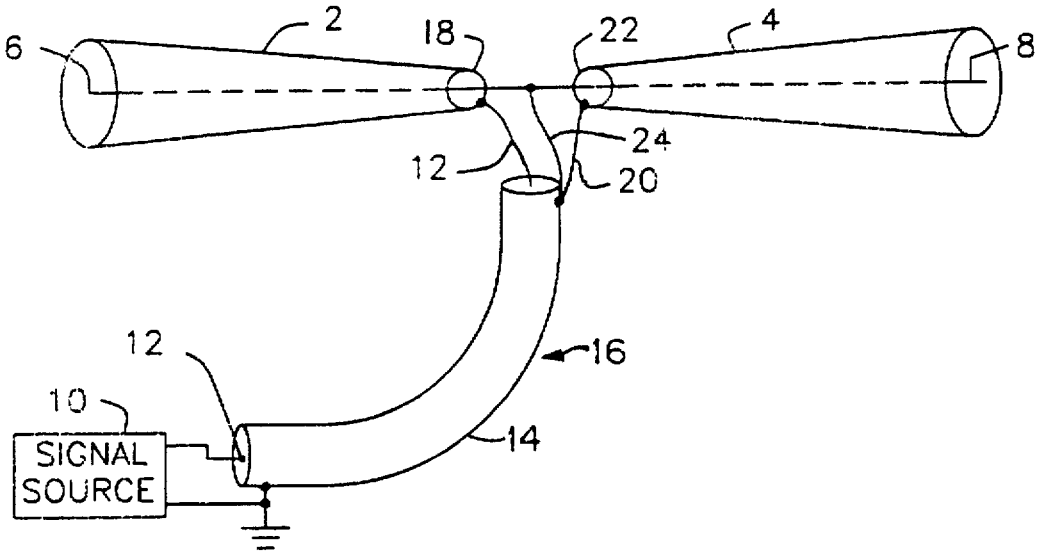
FIG. 1 shows a dipole antenna of this invention in which the hollow conductors are truncated cones and the central conductors are rods or wires.

In this description corresponding components in the different figures of the drawing will be designated in the same manner.

The dipole antenna shown in FIG. 1 is comprised of hollow conductive elements 2 and 4 in the form of truncated cones having central grounded conductors 6 and 8 along their respective axes. A source 10 of radio frequency signals is connected between one end of an inner conductor 12 and the corresponding end of a braid 14 of a coaxial cable 16. The other end of the inner conductor 12 is connected to the smaller end 18 of the hollow conductor 2, and the other end of the braid 14 is connected via a wire 20 to the smaller end 22 of the hollow conductor 4 and to the central conductors 6 and 8 at points adjacent the respective smaller ends 18 and 22 of the hollow conductors 2 and 4. The latter connections are most easily made by connecting the adjacent ends of the central grounded conductors 6 and 8 and connecting the braid 14 to them via a wire 24. The space between the hollow conductor 2 and its central conductor 6, and the space between the hollow conductor 4 and its central conductor 8 are preferably filled with electrically insulating material such as air or different insulating materials which can control the physical thickness due to their different dielectric constants and different voltage breakdown ratings.

Figure 2:
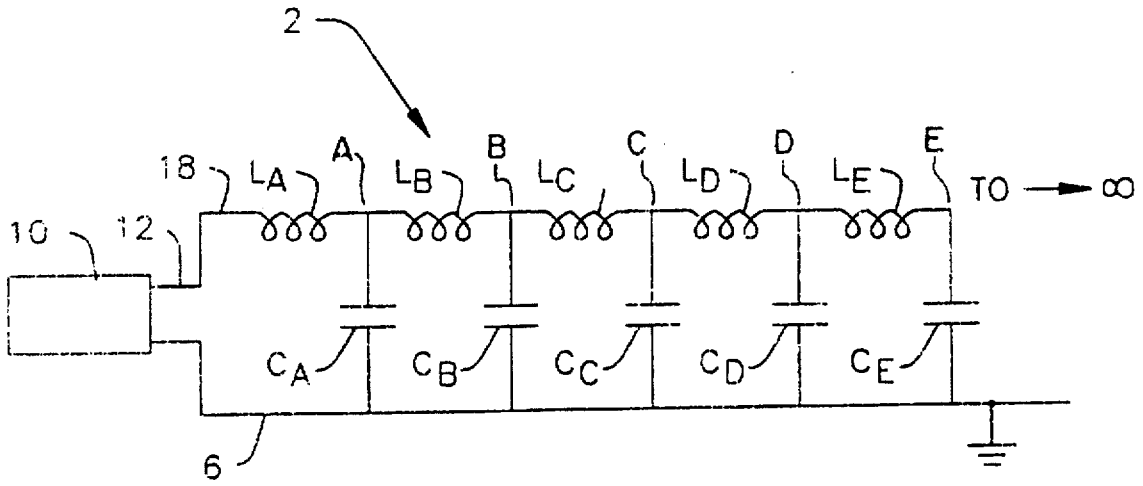
FIG. 2 is a schematic representation of incremental filters occurring along an antenna element.

Reference is made to the schematic representation of the electrical circuit for either one of the hollow and central conductors 2, 6 and 4, 8 shown in FIG. 2. Note that, although not shown, each inductor $L_A$ through $L_E$ has a corresponding inductor in the ground wires or conductors 6 and 8 so that $L_A$ through $L_E$ represents the sum of $(L_{A1}+L_{A2}+L_{B1}+L_{B2}+L_{C1}+L_{C2+LD1}+L_{D2}+L_{E1}+L_{E2})$.

Only the hollow conductor 2 and the central conductor 6 will be discussed, but the discussion applies equally to the hollow conductor 4 and the central conductor 8. Although the inductance of the conductors 2 and 6 is distributed along their length, it is shown for the purpose of explanation to be comprised of a series of inductors $L_A$, $L_B$, $L_C$, $L_D$, and $L_E$, and although the capacitance between the hollow conductor 2 and the central conductor 6 is distributed, it is shown to be comprised of discrete capacitors $C_A$, $C_B$, $C_C$, $C_D$, and $C_E$. Because of the increasing distance between the hollow conductor 2 and the central conductor 6 from the end 18 outward, the capacitances of these capacitors decrease ie $C_A>C_B>C_C>C_D>C_E$. Thus, at points A, B, C, D and E from the input 18 successive discrete low pass filters are formed whereas in an actual antenna of the invention an infinite number of low pass filters is formed.

Figure 3A:
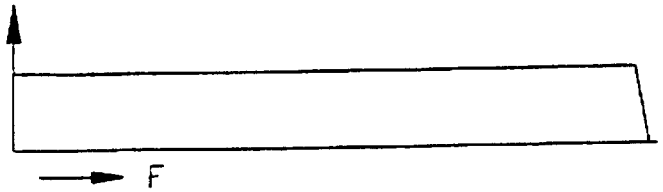
FIGS. 3A, 3B, 3C, 3D and 3E show the responses of the incremental filter element shown in FIG. 2.
Figure 3B:
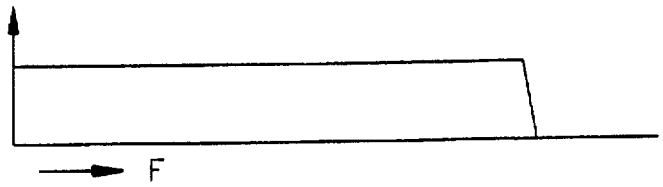
Figure 3C:
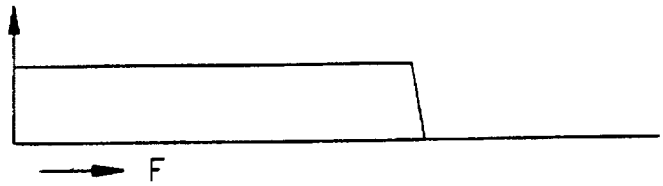
Figure 3D:
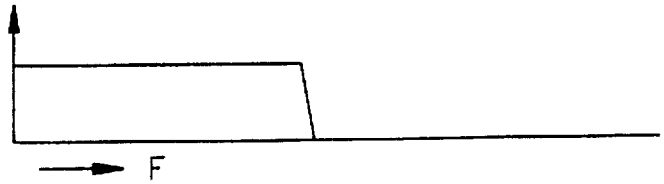
Figure 3E:
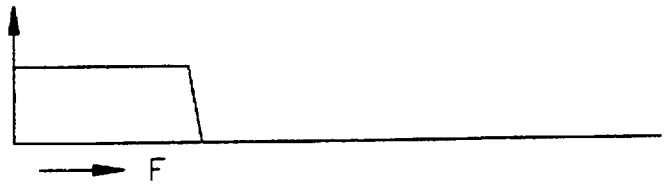

From an examination of FIG. 2, it can be seen that at point A, the filter formed by $L_A$ and $C_A$ will have a high cut-off frequency as indicated in FIG. 3A so that only a small length of the elements 2 and 6 are energized as is required for efficient radiation of high frequencies. At point B, the inductances $L_A$ and $L_B$ and the capacitors $C_A$ and $C_B$ form a low pass filter having a lower cut-off frequency as indicated in FIG. 3B so that the length of the elements 2 and 6 that is energized is longer as required. Similarly, the cut-off frequencies as indicated by FIGS. 3C, 3D and 3E occur at points C, D and E. In an actual antenna, efficient radiation can be attained for any and all frequencies emanating from the source 10 between the low cut-off frequency of the full length of the conductors 2 and 4 and the high cut-off frequency at the input 18.

Figure 4:
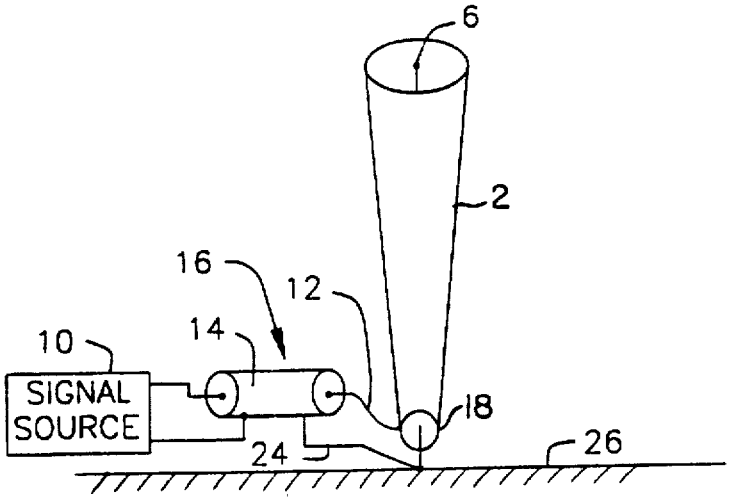
FIG. 4 shows a monopole antenna of this invention in which the hollow conductor is a truncated cone and the central conductor is a rod.

FIG. 4 shows the use of the invention as a monopole antenna wherein the hollow conductor 4 and its central conductor 8 are eliminated and the lead 24 and one end of the rod 6 are connected to a ground plane 26.

Figure 5:
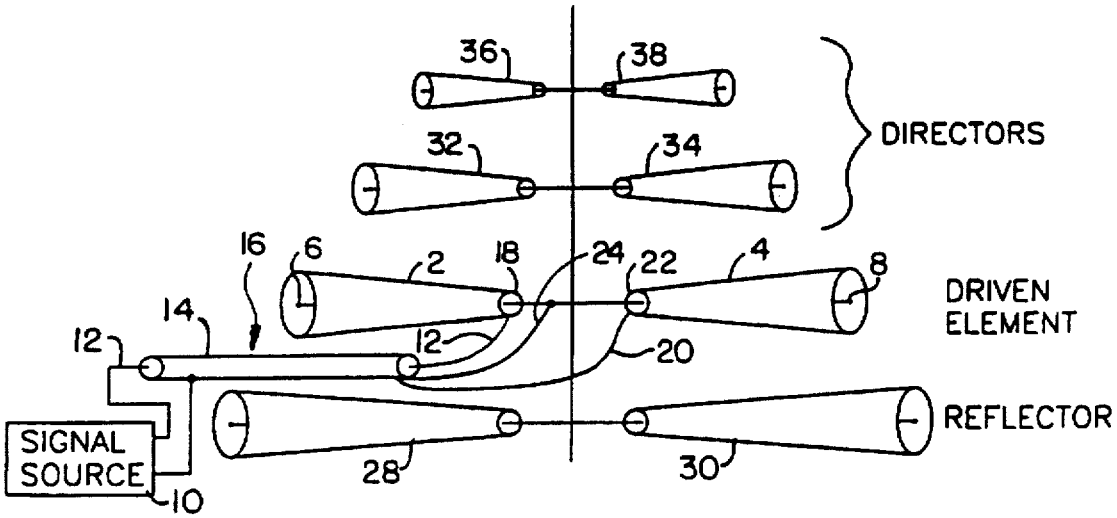
FIG. 5 shows a Yagi antenna utilizing the invention in which all elements are truncated cones and the central conductors are rods.

FIG. 5 shows the use of the invention in a Yagi array having reflectors 28 and 30, and directors 32, 34, 36 and 38. Note that the effective lengths of the parasitic (undriven) elements will obey the same laws as the actual physical lengths of a standard Yagi. It is true that in a standard Yagi, both the length and spacing of the parasitic elements are determined by the frequency and are governed by mathematical formulae. This will also be true in this invention type Yagi. The effective lengths (or cone shapes) are determined the same as for the radiating elements. However, the spacing between elements does affect the operation, and it will have to be determined if compensating adjustments in the shape of these cones will have to be made to keep the spacing between elements electrically correct.

Figure 6:
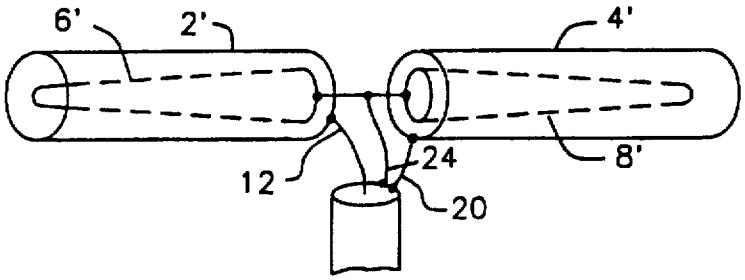
FIG. 6 shows a dipole antenna of the invention in which the hollow conductors are cylinders and the central conductors are truncated cones.
Figure 7:
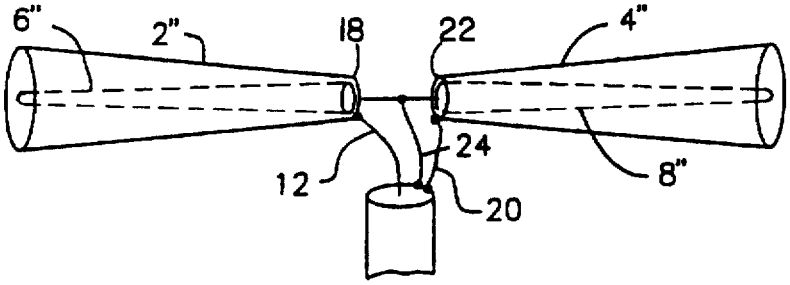
FIG. 7 shows dipole antenna of the invention in which both the hollow conductors the central conductors are truncated cones.
Figure 8:
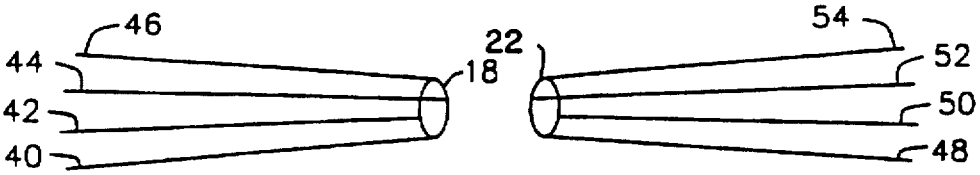
FIG. 8 shows a skeletal form of the hollow conductors of a dipole antenna the invention formed from rods.

Thus far, the hollow conductors 2 and 4 have been shown as truncated cones and the central conductors 6 and 8 have been shown as rods, but as illustrated in FIGS. 6, 7 and 8, other configurations are possible. It is only necessary that the hollow conductors 2 and 4 and the central conductors 6 and 8 be respectively shaped so that the capacitance between the inner surfaces of the hollow conductors 2 and 4 and the outer surfaces of the central conductors 6 and 8 respectively decrease with the distance from the input 18.

Thus in FIG. 6, the hollow conductors are cylinders 2' and 4' and the central conductors are truncated cones 6' and 8' that are larger at their input ends 18 and 22 than at their outer ends.

In FIG. 7, the hollow conductors are truncated cones 2" and 4" and the central conductors are also a truncated cones 6" and 8".

In any of these configurations, conductors in the shape of cylinders or truncated cones can be comprised of conductive rods. As shown in FIG. 8, rods 40, 42, 44 and 46 effectively form a hollow conductor such as 2 or 2". The central conductors are not shown in order to simplify the drawing.

The central conductors 6', 8' of FIG. 6 and 6", 8" of FIG. 7 could be formed with a plurality of rods as shown in FIG. 8. Note that it is preferred that the central conductors be on the axis of the associated hollow conductor. If the center rod were off-center, for example, closer to the right (or top) side and further from the left (or bottom) side, the capacitance of the left side would decrease along its length faster than if it were centered, while the capacitance of the right side would decrease more slowly, or even increase along its length. This phenomenon could be used as a form of vernier adjustment or control of the antenna's characteristics, but if carried too far, it could bring the antenna into resonance at a single frequency, which is counter to the objects of the present invention.

Although various embodiments of the invention have been shown and described herein, they are not meant to be limiting. Those of skill in the art may recognize certain modifications to these embodiments, which modifications are meant to be covered by the spirit and scope of the appended claims.

What is claimed is:

1. A broad band antenna element comprising:

a hollow conductor configured as a cylinder;

a central conductor configured as a truncated cone and mounted within the hollow conductor;

the inner surface of the hollow conductor and the outer surface of the central conductor being such that the capacitance between them decreases from one end of the antenna element to the other.

2. A broad band antenna element as set forth in claim 1 wherein said hollow conductor is comprised of a plurality of conductive rods.

3. A dipole antenna comprised of first and second antenna elements as set forth in claim 1, the said elements being aligned with their ends having the most capacitance between their respective hollow and central conductors adjacent to each other.

4. A dipole antenna as set forth in claim 3 further comprising:

a first lead connected to the end of the hollow conductor of said first antenna element having the most capacitance with respect to its central grounded conductor;

a second lead connected to the adjacent ends of said central conductors; and a third lead connected to the end of the hollow electrode of said second antenna element having the most capacitance.

5. A monopole antenna comprising:

an antenna element as set forth in claim 1;

a ground plane;

a first lead connected to the end of the hollow conductor of said first antenna element having the most capacitance with respect to its central conductor; and a connection between the ground plane and the end of said central conductor having the most capacitance with respect to its hollow conductor.

6. A broad band antenna element comprising:

a hollow conductor configured as a truncated cone;

a central conductor configured as a truncated cone and mounted within the hallow conductor;

the inner surface of the hollow conductor and the outer surface of the central conductor being divergent in opposite directions such that the capacitance between them decreases from one end of the antenna element to the other.

7. A broad band antenna element as set forth in claim 6 wherein said hollow conductor is comprised of a plurality of conductive rods.

8. A dipole antenna comprised of first and second antenna elements as set forth in claim 6, said antenna elements being aligned with their ends having the most capacitance between their respective hollow and central conductors adjacent to each other.

9. A dipole antenna as set forth in claim 8 further comprising:

a first lead connected to the end of the hollow conductor of said first antenna element having the most capacitance with respect to its central grounded conductor;

a second lead connected to the adjacent ends of said central conductors; and a third lead connected to the end of the hollow electrode of said second antenna element having the most capacitance.

10. A monopole antenna comprising:

an antenna element as set forth in claim 9;

a ground plane;

a first lead connected to the end of the hollow conductor of said first antenna element having the most capacitance with respect to its central conductor; and a connection between the ground plane and the end of said central conductor having the most capacitance with respect to its hollow conductor.

* * * * *